United States Patent [19]

Farage

[11] 3,952,767

[45] Apr. 27, 1976

[54] MEANS FOR TREATING ROOTS ABOUT DRAIN LINES

[76] Inventor: Fred Farage, 1002 E. Northern Ave., Phoenix, Ariz. 85020

[22] Filed: June 21, 1974

[21] Appl. No.: 481,521

Related U.S. Application Data

[62] Division of Ser. No. 272,030, July 14, 1972, Pat. No. 3,830,659.

[52] U.S. Cl. ..... 137/268; 23/272.7; 23/267 B

[51] Int. Cl.[2] ..... B08B 9/04

[58] Field of Search ..... 137/268, 576; 23/267 F, 23/267 B, 272.7, 272.8; 134/22 C, 34

[56] References Cited

UNITED STATES PATENTS

| | | | |
|---|---|---|---|
| 549,570 | 11/1895 | Jones | 23/272.7 |
| 593,378 | 11/1897 | Jones | 23/267 B |
| 1,142,292 | 6/1915 | White, Jr. | 23/272.7 |
| 1,350,175 | 8/1920 | O'Connor | 23/267 B X |
| 1,930,500 | 10/1933 | Archibald | 23/272.7 |
| 2,099,836 | 11/1937 | Blanchard et al. | 23/272.7 |
| 2,397,328 | 3/1946 | Ripley | 134/22 C |
| 2,627,977 | 2/1953 | Kent | 23/267 B |
| 3,386,808 | 6/1968 | Handeland | 23/272.7 |

*Primary Examiner*—Martin P. Schwadron
*Assistant Examiner*—Robert J. Miller

[57] ABSTRACT

The disclosure relates to a means and method for treating roots about drain lines so that such roots do not plug or impede the flow of fluid through such drain lines, the means comprising a male fitting adpated for disposition in a female drain line cleanout structure and a chemicals container is suspended from the male fitting and adapted to hold crystalline or other suitable dissolvable chemicals such as copper sulphate or the like, and water inlet means is adapted to introduce water through the male fitting and into the chemicals container so that the water will flow through the crystals and overflow from an elevated outlet in the side of the container above an area into which water is introduced into the chemicals container; a vent means provides communication of the atmosphere with the interior of the water inlet tube and a connection means is provided for introducing water into the inlet tube at a level below the atmospheric vent.

1 Claim, 8 Drawing Figures

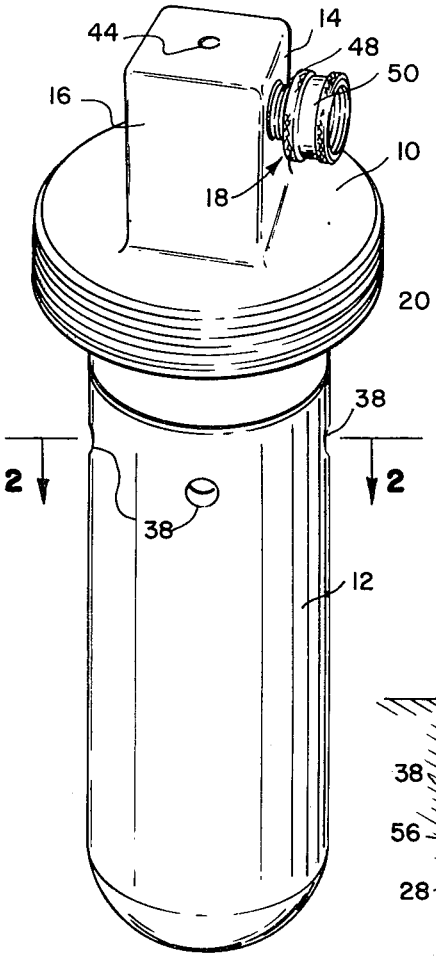
FIG.1.
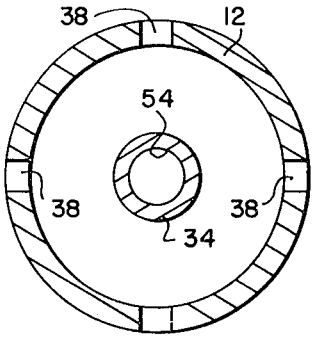
FIG.2.
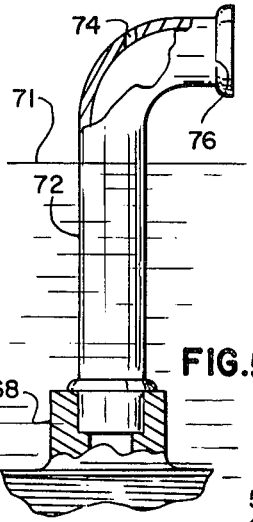
FIG.5.
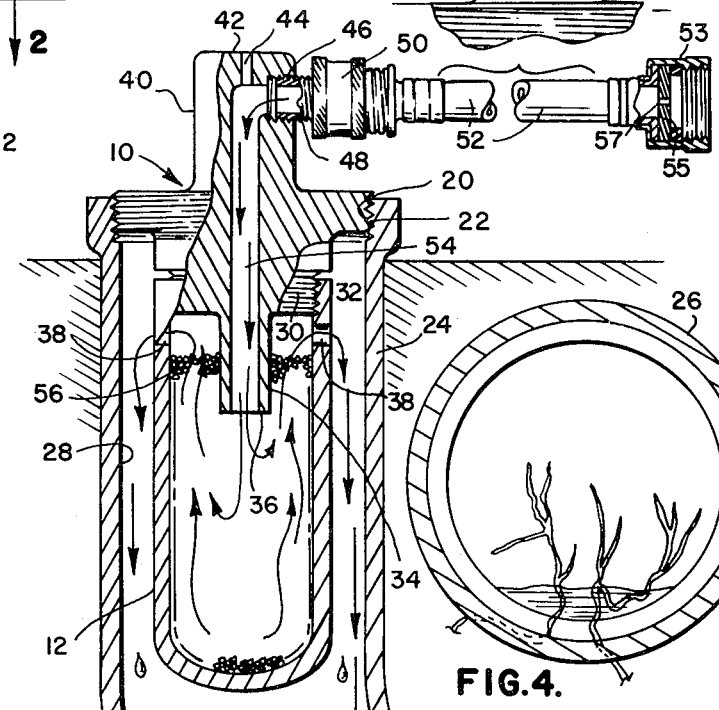
FIG.4.
FIG.3.
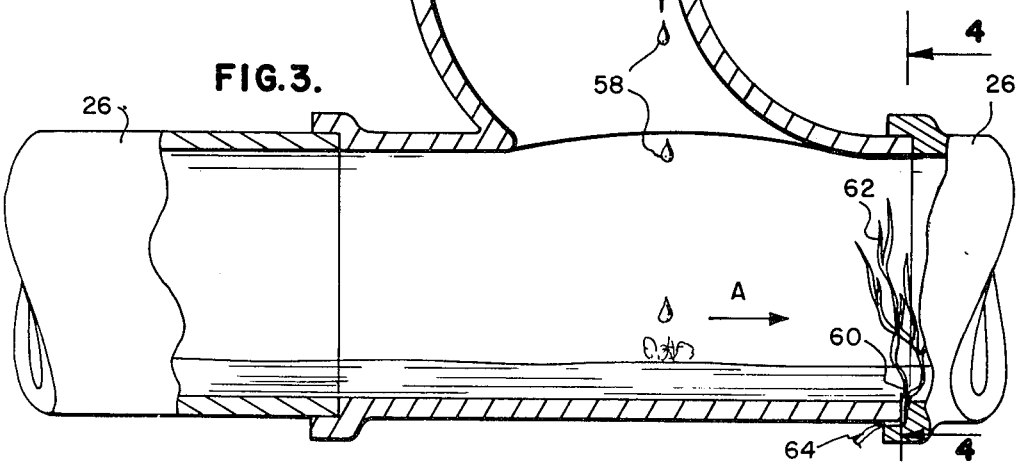

MEANS FOR TREATING ROOTS ABOUT DRAIN LINES

This is a division of application Ser. No. 272,030, filed July 14, 1972, now U.S. Pat. No. 3,830,659.

The method of the invention relates generally to a long term trickle feed of root killing chemicals into a drain line.

BACKGROUND OF THE INVENTION

Various drain lines such as drain lines to sewers and septic tanks, or leaching beds, have required periodic maintenance due to the growth of tree roots in areas where there is water seepage from joints in the drain lines. In many instances roots grow through joints in drain lines and fill the drain lines such as to cause them to plug and become inoperative.

Many methods have been used to clear the roots from the drain lines, including mechanical rotary cutters as well as various chemical treatments.

It has been a common practice to introduce various chemicals such as copper sulphate crystals into the plumbing via a conventional toilet bowl or other fixture in a dwelling or the like, and in accordance with such treatment short term chemical action is attained relative to roots in drain lines and at the joints thereof.

It has become well known that the introduction of a batch of chemicals such as copper sulphate crystals into a toilet bowl provides short term and almost momentary treatment of roots in drain lines due to the fact that the flushing of the toilet bowl carries the crystals downwardly into the drain line and in many instances the chemicals flow past the critical root invasion area before fully dissolving and consequently batch treatment only provides short term exposure of the invading roots to the chemical such as copper sulphate or the like.

When the roots are subjected to such short term treatment they may be slightly damaged but are not caused to completely recede from the seepage openings in the drain line and tend to grow back quite rapidly thus necessitating constant maintenance attention and frequent intermittent treatments by flushing batches of chemicals down the toilet or by introducing such chemicals through other fixtures in connection with the drain line plumbing.

The principal difficulty in such prior art treatment methods is that drain lines become plugged and are only free for short periods of time when the bath treatment method is resorted to.

SUMMARY OF THE INVENTION

The present invention relates to a means and method for treating roots about drain lines; the invention comprising a very simple male fitting and container structure adapted to be placed in conventional female plumbing cleanout structures and wherein chemicals are contained so as to promote a method of continuous long term trickle feeding of chemicals into drain lines so that roots which have grown into the drain lines are subjected to the action of chemicals over a long period of time which results in not only killing and shrinking the roots inside the drain line but also causing the roots to be killed completely in the seepage areas through which the roots have grown and which therefore also causes regression of the roots and seepage of the chemicals outwardly into surrounding areas near the drain line, and to thus prevent further growth of the roots thereinto.

The invention includes a very simple chemicals container supported on a male structure carried in a female cleanout plumbing fixture, and the chemicals container includes a water inlet tube having an outlet considerably below an overflow outlet in the container so that water may be introduced in a slight trickle through the chemicals and wherein the chemicals which are dissolved are carried by the trickle of water through the overflow of the container and into the cleanout fitting and downwardly into the drain line. The constant trickle of dissolved chemicals over a period of several days or weeks causes killing of the roots and also the roots outside the drain line and in the surrounding area, and thus preventing regrowth of roots into the drain line.

In accordance with the invention, copper sulphate crystals are utilized in the container of the invention and the chemistry thereof, as it is dissolved, appears as follows: $Cu\ SO_4 + 2H_2O - H_2\ So_4 + CuO_2$. From the foregoing it will be seen that sulphuric acid is produced when the crystals are dissolved and that roots of trees entering at 60 as shown in FIG. 3 of the drawings will be killed and dissolved and shrunk away by the sulphuric acid during a long term trickle flow of the acid around the roots. The sulphuric acid will then migrate outwardly through the crack into which the roots 60 have grown and the sulphuric acid concentrate will percolate through the soil for a short distance so as to cause the roots to withdraw from the area; however, as the sulphuric acid is dissipated, the free copper oxide will be available to roots of trees at the perimeter of the percolation area where the concentration of acid has been reduced by reaction with the soil.

Accordingly, the ecology of the method according to the invention is beneficial to the trees after the roots have withdrawn from the percolation area around the drain line.

The slow trickle feed of dissolved copper sulphate crystals is very effective over a substantial period of time, as for example, this trickle feed should continue for a period of at least four to twelve hours and the flushing of large amounts of water down the drain line should be avoided, as for example the flushing of toilets should be avoided as much as possible so as to minimize the dilution of acid at the area where it trickles into the proximity of the roots where they enter the drain line.

The means of the invention is a very simple structure which may readily be adapted to screw into or fit into any conventional female cleanout plumbing fitting communicating with a respective drain line.

Additionally, the invention includes novel atmospheric vent means disposed above the water inlet structure which allows water to trickle into the chemicals container of the invention so that backflow into the water supply cannot happen due to siphoning or other action.

Additionally, a water trap is provided in the chemicals container of the invention due to the fact that the water inlet tube is provided with an outlet considerably below the overflow outlet of the container which holds the chemicals such as copper sulphate crystals or the like.

The means of the invention affords a very effective operational method for the killing of roots in drain lines and for causing the recession of such roots from cracks or leaks or openings in the drain line, and for treating the soil around the areas of such openings or cracks to prevent the regrowth of the roots into the drain lines.

The method of operation comprises a long term trickle of chemicals into the drain line so that constant application of the chemicals is maintained over a long period of time and therefore providing very effective treatment of the roots to prevent growth and to prevent plugging of the drain lines thereby.

Accordingly, it is an object of the invention to provide a means for treating roots about drain lines which may be very readily and easily installed in conventional drain line cleanouts and which provides a very effective method for treating roots in drain lines, and for killing the roots and preventing further regrowth thereof.

Another object of the invention is to provide a very economical means for treating roots about drain lines and thereby obviating expensive plumbing service normally attendant to drain lines in areas where tree roots grow.

Another object of the invention is to provide a very safe and simple means for treating roots about drain lines wherein an atmospheric vent is provided to prevent siphoning of water from the drain line or the means of the invention back into the water supply used for trickle feeding of the means of the invention, and further, the invention employs a suitable liquid trap to prevent gases from passing from the drain line outwardly through the atmospheric vent of the invention.

Another object of the invention is to provide a novel and simple means for treating roots about drain lines which may be installed very readily and which may use a trickle flow of water from a conventional garden hose which may readily be attached to said means.

Another object of the invention is to provide means for dissolving copper sulphate crystals in water so as to produce sulphuric acid and free copper so that the acid may kill the roots and percolate up into the surrounding area where the roots have entered the drain line, and further, the free copper from the copper sulphate at the perimeter of the percolation area may be available to the roots of trees so that the ecology of the method is actually nutritious to trees as their roots withdraw from the immediate area of the drain line.

Further objects and advantages of the invention may be apparent from the following specification, appended claims and accompanying drawings.

BRIEF DESCRIPTION OF THE DRAWINGS

FIG. 1 is a perspective view of a means for treating roots about drain lines in accordance with the present invention;

FIG. 2 is a horizontal sectional view taken from the line 2—2 of FIG. 1, showing the structure on a large scale;

FIG. 3 is a fragmentary vertical sectional view of a drain line cleanout structure, showing the invention installed therein and showing portions thereof in section and in elevation to amplify the illustration, and further showing the flow of water therethrough to dissolve crystal chemicals and to provide a trickle feed of chemicals into the drain line;

FIG. 4 is a transverse sectional view taken from the line 4—4 of FIG. 3;

FIG. 5 is a fragmentary view of a modification of the water inlet means used in connection with the invention;

DESCRIPTION OF THE PREFERRED EMBODIMENTS

Figure 6:
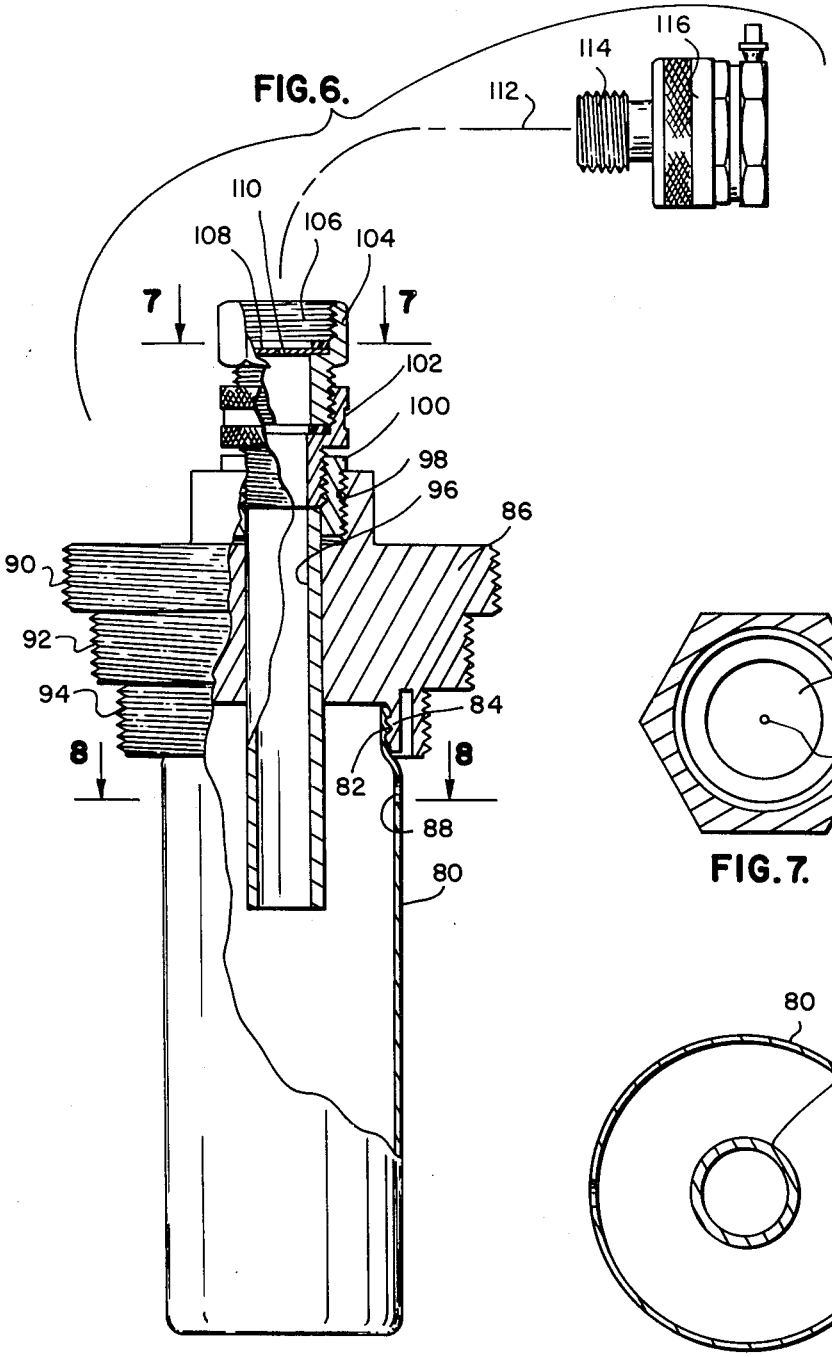
FIG. 6 is a modification of the invention showing a plurality of diametrically stepped groups of screw threads adapted each individually to fit a certain size cleanout so that the unit is universally adaptable to the various sizes of cleanouts in existence.
Figure 7:
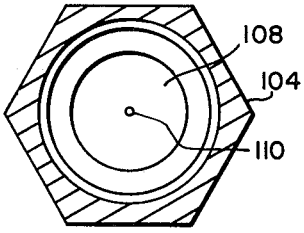
FIG. 7 is an enlarged plan sectional view taken from the line 7—7 of FIG. 6.
Figure 8:
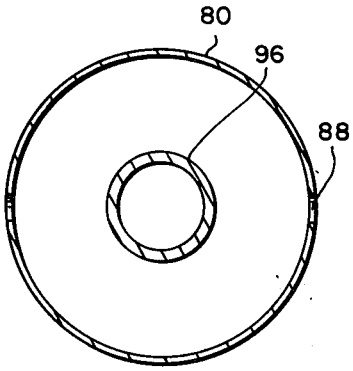
FIG. 8 is an enlarged plan sectional view taken from the line 8—8 of FIG. 6.

As shown in FIG. 1 of the drawings, the invention comprises a male fitting 10 suspendingly supporting a generally hollow tubular chemicals container 12 and screw threadably attached to a side 14 of a projection 16 at the upper end of the fitting 10 is a connection means 18 adapted for the connection of a conventional garden hose thereto.

As shown in FIG. 3, on reduced scale, the male fitting 10 is provided with peripheral screw threads 20 which are screw threadably engaged in internal screw threads 22 of a conventional hollow tubular female cleanout structure 24 which is coupled to a conventional drain line 26, and which forms an intermediate part thereof.

The cleanout structure 24 is provided with a hollow tubular generally vertical portion having a bore 28 in which the chemicals container 12 is suspendingly supported by the male fitting 10. The male fitting 10 is provided with external screw threads 30 engaging internal screw threads 32 at an upper open end of a generally hollow cup-shaped chemicals container 12.

Supported by the male fitting 10 is a water supply tube 34 which extends downwardly into the chemicals container 12 and this tube 34 is provided with an open water outlet end 36 which is at a position substantially below overflow outlet openings 38 in the sidewall of the chemicals container 12 so as to provide a water trap therein and also to provide for the overflow of chemicals containing water, as will be hereinafter described.

The male fitting 10 is provided with an upwardly directed projection 40 having an upper end 42 provided with an atmospheric vent opening 44 which communicates with the interior of the hollow tube 36, which extends upwardly into the projection 40.

The side of the projection 40 is provided with an internally screw threaded bore 46 in which an externally screw threaded portion 48 of a fitting 50 is secured. This fitting 50 is adapted to provide screw threaded connection of a conventional garden hose 52, or any other tubular water conduit as desired.

It will be seen that the male fitting 10 is provided with an internal bore portion 54 communicating with the fitting 46 and with the vent opening 44 and this bore portion 54 is continued by means of the water inlet tube 34, and the bore continues on through to the lower opening end 36, all as shown best in FIG. 3 of the drawings.

In operation, the male fitting 10 may be removed from the cleanout structure 24 and the chemicals container 12 may be screw threadably removed from the male fitting 10 so as to place copper sulphate or other chemical material 56 therein. This material 56 is preferably water soluble material, and when disposed in the container 12 and installed on the male fitting 10, as shown in FIGS. 1 and 3 of the drawings, water may be introduced in a slow trickle through the tube 52 and downwardly through the bore 54 and outwardly through the open end 36. This slow trickle gradually fills the chemicals container 12 to the overflow outlet openings 38 at which time chemicals dissolved by the water is carried in the water downwardly and is fed into the drain line 26 as indicated by the disclosure of droplets 58 in FIG. 3 of the drawings. These droplets of water contain the chemicals dissolved from the crystals or other dissolvable material 56 and a slow trickle of the dissolved chemicals in the water passes into the drain line and moves generally in the direction of the arrow A in FIG. 3 of the drawings, at a slow rate, and consequently may be continued for weeks at a time so that the material slowly trickled in and that which gravitates to the bottom will pass into a joint area 60 through which roots 62 normally tend to grow. With a continued application and trickle of the liquid chemicals into the joint area 60, the roots which have grown thereinto are killed and are shrunk away and dissipated such that the liquid chemicals over a period of time will gradually seep through the joint area 60 and into the soil 64 below the joint area 60, and with a concentration of the liquid chemicals in the soil 64 the roots tend to withdraw from this area and are thus prevented from regrowing into the drain line 26.

As shown in FIG. 3, the hose 52, at its inlet end comprises a conventional screw threaded coupling 53 adapted to be coupled to a faucet. An orifice plate 55 is disposed in the coupling 53, and has an orifice 57 therethrough which may be, for example, 0.0015 inch to 0.025 inch in diameter, so as to allow a slow trickle of water to pass through the hose 52.

It will be understood that the method of the invention comprises a low rate trickle of chemicals for a substantial length of time in contrast to the usual and conventional method of flushing a substantial batch of chemicals through the drain line which only causes momentary contact of the chemicals with the roots 62 and which depends upon chance that some crystals of the chemicals will be trapped in the roots.

In operation, the water passes through the orifice 57 and hose or tube 52 and downwardly through the bore 54 and percolates up through the crystals 56, thereby dissolving them and carrying some of the chemicals through the overflow outlet openings 38 and downwardly into the drain line 26. At this time a liquid trap is maintained in the chemicals container between the open end 36 of the water inlet tube and the overflow openings 38.

Additionally, the atmospheric vent 44 provides a vent to prevent any siphoning from the container 12 into the water inlet tube 52, and also provides for an indication of overcharging of the chemicals container 12 with water in the event too much flow is introduced through the hose or tube 52.

The modification as shown in FIG. 5 comprises a top portion 68 of a male fitting similar to the fitting 10. A standpipe 72 extends upward thereabove to a position above ground water 71 which may occur with lawn irrigation for example. A siphon breaking orifice 74 is similar to the orifice 44. The orifice 74 is thus held above the water level 71 to prevent siphoning action. It will be understood that a conventional siphon breaker may be installed in connection with the tube 52 and amy be used in place of either of the orifices 44 or 74. A fitting 76 of the standpipe 72 is adapted for connection of a hose or tube fitting such as the fitting 48.

Accordingly, operation of the device over a long term, as hereinbefore described, requires that water entering the tube 52 and the bore 54 may be a low rate trickle so that a batch of copper sulphate or other crystals may last for weeks and provide for leaching of the chemicals from the crystals into the water and into the droplets 58 which enter the drain line 26.

As shown in FIG. 6 of the drawings, a container 80 is similar to the container 12. The container 80 is provided with external screw threads 82 screw threaded into internal screw threads 84 of an adapter fitting 86. The container 80 is provided with outlet openings 88 similar to the openings 38 of the container 12.

The adapter 86 is similar to the male fitting 10 and constitutes a male fitting having three groups of threads of different diameters. A group of threads designated 90 is of the largest diameter; another group of threads 92 is of a substantially reduced diameter; and a third group of threads 94 is of the smallest diameter, such that the groups are diametrically stepped to accommodate various internal screw threads such as the internal screw threads 22 of the female cleanout structure 24 shown in FIG. 3. Inasmuch as these cleanout structures vary in diameter, the various groups 90, 92 and 94 of the threads as shown in FIG. 6 of the drawings are so arranged that one of them will fit the particular internal screw threads of the various female cleanout fittings.

Extending through the male adapter is a tube 96 similar to the tube 34 hereinbefore described, and in the upper end of the male adapter 86 are internal screw threads 98 holding a fitting 100 which carries a conventional hose fitting 102 and screwed into this hose fitting 102 is an orifice supporting fitting 104 having internal threads 106 adapted to receive the end of a hose or the like so as to supply water to an orifice plate 108 having a small central orifice 110 extending therethrough. This orifice 110 is so designed and sized that it will allow a small trickle of water to pass downwardly into the container 80 and gradually to dissolve a load of crystals such as copper sulphate crystals so that dissolved chemicals will continue to flow into the drain line 26 for a substantial period of time, as for example 12 hours or more, in order to provide an effective treatment for roots, as hereinbefore described, and as will be hereinafter described in accordance with the detailed description of the method.

A broken line in FIG. 6 indicates a tubular conduit 112 which may be a garden hose or the like, connectable to a screw threaded portion 114 of a conventional siphon breaker 116 which may be secured to the usual water outlet faucet coupled to domestic water supply.

In accordance with the method of the invention, chemical crystals of a water soluble type are preferably used in the container 80, and copper sulphate has been well known to be effective in killing roots in drain lines, and also has been ecologically satisfactory for such purposes. The chemistry is as follows:

$$Cu\,SO_4 + 2H_2O - H_2So_4 + CuO_2$$

The foregoing indicates that copper sulphate crystals in the container 80, when dissolved by water entering the orifice 110 will react to produce hydrochloric acid and copper oxide, which will pass downwardly into the drain line 26 and around roots 62, and downwardly through the opening 60, causing the roots to shrink and die away and retract from the opening. The sulphuric acid as well as the copper oxide will migrate and percolate out into the soil surrounding the drain line, and the roots will withdraw to a perimeter area of the percolated soil where the concentration of the sulphuric acid has reached a tolerable level due to its reaction with the soil, and the copper oxide in the perimeter of the percolated area may be available to the roots of the trees, and moisture, as it passes from the drain line and as the sulphuric acid reacts with the soil, will reach an area where it is available to the roots without causing them damage.

It is recommended in accordance with the present method that a trickle feed of the dissolved chemicals may continue to flow into the drain line, as hereinbefore described, for a period of at least four hours, but preferably 12 hours or more, and further it is recommended that the flow of other liquids in the drain line should be minimized, as for example excessive flushing of toilets and other large flows of water should be avoided, and thus the flow of other liquids in the drain line should be minimized so as to permit the concentrated acid to be effective during the trickle flow period thereof into the drain line so that a concentrate of the acid is continually gravitating into and around the area 60 where the roots 62 emerge into the drain line.

It will be obvious to those skilled in the art that the present invention, as well as the method for using it, provides long term treatment of roots which kills the roots internally of the drain line, and which kills the roots in the joint openings through which the roots have grown, and further treats the soil in the surrounding areas at the lower sides of the drain line so that the roots will recede from the area of the drain line in the soil surrounding the lower side thereof.

Accordingly, roots are initially killed in the line and subsequently prevented from growing therein due to the fact that long term flow of the liquid chemicals causes sufficient seepage of these chemicals through the joint opening so as to impregnate the soil in the surrounding areas of the joint openings to cause recession of root growth in such areas.

It will be obvious to those skilled in the art that various modifications may be resorted to without departing from the spirit of the invention.

I claim:

1. Means for treating roots about drain lines, comprising: a male fitting having peripheral structure adapted to fit a generally tubular female plumbing cleanout structure; a hollow chemicals container coupled to said male fitting and normally suspendingly supporting said container therebelow; said container having a closed bottom and sidewall structure extending upwardly from said bottom; said sidewall structure having an overflow outlet opening therein; said overflow outlet opening being spaced substantially above said bottom; and water inlet means coupled to said male fitting and disposed for introducing water into said chemicals container; said male fitting at said peripheral structure is provided with screw threads adapted screwthreadably to engage conventional internal screwthreads of a female plumbing cleanout structure; said threads comprising a plurality of groups of screw threads; each group of screw threads being of a different pitch diameter; said groups diametrically stepped relative to each other; one of said group of threads having the largest pitch diameter; another of said groups of threads having the smallest pitch diameter; the group having the smallest pitch diameter being closest to a normally lower end of said container.

* * * * *